US008624734B2

(12) United States Patent
Inomata et al.

(10) Patent No.: US 8,624,734 B2
(45) Date of Patent: Jan. 7, 2014

(54) INTRUDER IDENTIFYING METHOD, INTRUDER IDENTIFYING DEVICE AND INTRUDER IDENTIFYING SENSOR DEVICE

(75) Inventors: Kenji Inomata, Tokyo (JP); Atsuhisa Nakanishi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 992 days.

(21) Appl. No.: 12/640,240

(22) Filed: Dec. 17, 2009

(65) Prior Publication Data

US 2010/0156636 A1 Jun. 24, 2010

(30) Foreign Application Priority Data

Dec. 22, 2008 (JP) ..... 2008-325160

(51) Int. Cl.
*G08B 13/00* (2006.01)

(52) U.S. Cl.
USPC ..... 340/541; 340/552; 340/561

(58) Field of Classification Search
None
See application file for complete search history.

(56) References Cited

U.S. PATENT DOCUMENTS 4,419,659 A * 12/1983 Harman et al. ..... 340/552
4,562,428 A 12/1985 Harman et al.
4,595,924 A * 6/1986 Gehman ..... 342/28
2001/0052871 A1 12/2001 Fukae et al.
2004/0223056 A1 * 11/2004 Norris, Jr. ..... 348/152
2008/0266088 A1 10/2008 Oyamada

FOREIGN PATENT DOCUMENTS

JP 59-27397 A 2/1984
JP 03-152697 6/1991
JP 10-095338 A 4/1998
JP 2001-056375 A 2/2001
JP 2001-343458 A 12/2001
JP 2003-339043 A 11/2003
JP 2004-138402 5/2004
JP 2005-190146 A 7/2005
JP 2008-276473 11/2008

* cited by examiner

*Primary Examiner* — Mohammad Ghayour
*Assistant Examiner* — Brian Wilson
(74) *Attorney, Agent, or Firm* — Buchanan Ingersoll & Rooney PC

(57) ABSTRACT

In an intruder identifying method and device, an intruder identifying sensor device identifies an intruder as a detection target to be originally detected by determining whether a variation style for a predetermined time of intruder intrusion state information based on the reception signal of the electric wave receiving unit during a time period from the time when the intruder identifying sensor device detects an intruder till the time when the intruder identifying sensor device does not detect the intruder is a predetermined variation style.

31 Claims, 6 Drawing Sheets

INTRUDER IDENTIFYING METHOD, INTRUDER IDENTIFYING DEVICE AND INTRUDER IDENTIFYING SENSOR DEVICE

BACKGROUND OF THE INVENTION

1. Field of the Invention

The present invention relates to an intruder identifying method, an intruder identifying device and an intruder identifying sensor device for disposing a leakage coaxial cable in an area or at a boundary where intrusion of an intruder is required to be monitored, and identifying, with electric waves, an intruder as a detection target which intrudes into an intrusion preventing area by approaching, traversing or overpassing the leakage coaxial cable.

2. Description of the Related Art

According to a conventional intruder detecting device for disposing a leakage coaxial cable in an area or at a boundary where intrusion of an intruder is required to be monitored, and detecting an intruder which traverses the leakage coaxial cable and intrudes into an intrusion preventing area, a reception signal comprising electric waves is transmitted from a transmission leakage coaxial cable, and it is received by a reception leakage coaxial cable to monitor the level of the reception signal. When an intruder intrudes between the transmission and reception leakage coaxial cables, the electric waves are interrupted, and thus the level of the reception signal is lowered. The level of the reception signal is determined on the basis of a predetermined threshold value at all times. Therefore, when the level of the reception signal is lower than the threshold value, "intrusion of intruder" is determined, and an alarm is output (for example, see Japanese Patent No. 3,703,689 (FIG. 1 and the description thereof), JP-A-10-95338 (FIGS. 3 and 4 and the descriptions thereof).

The conventional intruder detecting device using the leakage coaxial cable merely determine the reduction of the level of the reception signal on the basis of the threshold value. Accordingly, the reception level of the reception signal received through the reception leakage coaxial cable is also lowered in such a case that an object which is not originally required to be detected, for example, a small flying object such as a bird or the like, a small animal such as a dog, a cat or the like, water drops falling from leaves of trees in cluster due to wind or the like when the leakage coaxial cable is laid in woods, comes into contact with the leakage coaxial cable.

In the case of even a small animal, the variation amount of the reception signal is greater as it is nearer to the leakage coaxial cable, and thus there occurs such a problem that the level of the reception signal is lowered and an erroneous report "intruder intrudes" is output.

Furthermore, there is also a problem that the leakage coaxial cable itself or the ground surface, a walls or a pole around the leakage coaxial cable gets wet with falling rain, and thus the reflection and transmission coefficients thereof vary, so that the level of the reception signal is varied and thus an erroneous report "intruder intrudes" is output.

Still furthermore, the conventional intruder detecting device outputs an alarm "intruder intrudes" instantaneously when the level of the reception signal underruns the threshold value. Therefore, the level of the reception signal is lowered at the instantaneous time when a small flying object, a small animal or water drop which is not originally required to be detected comes into contact with the leakage coaxial cable as an antenna, and the threshold-value determination is made under this state, so that an erroneous report "intruder intrudes" is output.

SUMMARY OF THE INVENTION

The present invention has been implemented in view of the foregoing situation, and has an object to provide an intruder identifying method, an intruder identifying device and an intruder identifying sensor device that do not identify any object as a non-detection target which is not originally required to be detected, such as a small flying object, a small animal, water drop or the like, and also can identify an intruder as a detection target which is originally required to be detected.

According to the present invention, in an intruder identifying method for detecting intrusion of an intruder by using an intruder identifying device including an electric wave transmitting unit formed of a leakage coaxial cable which is laid on along the outer edge of an intrusion preventing area and emits electric waves, an electric wave receiving unit formed of a leakage coaxial cable which is laid on along the outer edge of the intrusion preventing area and receives the electric waves emitted from the electric wave transmitting unit and outputs a reception signal, and an intruder identifying sensor device for determining intrusion or non-intrusion of an intruder into the intrusion preventing area and an intrusion position on the basis of the reception signal output from the electric wave receiving unit, the intruder identifying sensor device identifies an intruder as a detection target by determining whether a variation style for a predetermined time of intruder intrusion state information based on the reception signal of the electric wave receiving unit during a time period from the time when the intruder identifying sensor device detects the intruder till the time when the intruder identifying sensor device does not detect the intruder is a predetermined variation style. Accordingly, an object which is not originally required to be detected is not recognized, and an intruding object (person) or the like which is originally required to be detected, that is, an intruder as a detection target can be identified.

Furthermore, according to the present invention, in an intruder identifying method for detecting intrusion of an intruder by using an intruder identifying device formed of an electric wave transmitting unit including a leakage coaxial cable which is laid on along the outer edge of an intrusion preventing area and emits electric waves, an electric wave receiving unit including a leakage coaxial cable which receives the electric waves emitted from the electric wave transmitting unit and outputs a reception signal, and an intruder identifying sensor device which is laid on along the outer edge of the intrusion preventing area for determining intrusion or non-intrusion of an intruder into the intrusion preventing area and an intrusion position on the basis of the reception signal output from the electric wave receiving unit, an intrusion detecting device at a first stage which is disposed at the outside of the electric wave transmitting unit and the electric wave receiving unit of the intrusion preventing area so as to be along the outer edge of the intrusion preventing area and initially detects intrusion of the intruder identifies an intruder as a detection target by determining whether a variation style for a predetermined time of intruder intrusion state information based on the reception signal of the electric wave receiving unit during a time period from the time when the intrusion detecting device at the first stage initially detects the intruder till the time when the intruder identifying sensor device does not detect the intruder is a predetermined variation style. Accordingly, an object which is not originally required to be detected is not recognized, and an intruding object (person) or the like which is originally required to be detected, that is, an intruder as a detection target can be identified.

Still furthermore, according to the present invention, in an intruder identifying device including an electric wave transmitting unit formed of a leakage coaxial cable which is laid on along the outer edge of an intrusion preventing area and emits electric waves, an electric wave receiving unit formed of a leakage coaxial cable which is laid on along the outer edge of the intrusion preventing area and receives the electric waves emitted from the electric wave transmitting unit and outputs a reception signal, and an intruder identifying sensor device for determining intrusion or non-intrusion of an intruder and an intrusion position on the basis of the reception signal output from the electric wave receiving unit, the intruder identifying sensor device identifies an intruder as a detection target by determining whether a variation style for a predetermined time of intruder intrusion state information based on the reception signal of the electric wave receiving unit during a time period from the time when the intruder identifying sensor device detects the intruder till the time when the intruder identifying sensor device does not detect the intruder is a predetermined variation style. Accordingly, an object which is not originally required to be detected is not recognized, and an intruding object (person) or the like which is originally required to be detected, that is, an intruder as a detection target can be identified.

Still furthermore, according to the present invention, an intruder identifying device including an electric wave transmitting unit formed of a leakage coaxial cable which is laid on along the outer edge of an intrusion preventing area and emits electric waves, an electric wave receiving unit formed of a leakage coaxial cable which is laid on along the outer edge of the intrusion preventing area and receives the electric waves emitted from the electric wave transmitting unit and outputs a reception signal, and an intruder identifying sensor device for determining intrusion or non-intrusion of an intruder into the intrusion preventing area and an intrusion position on the basis of the reception signal output from the electric wave receiving unit, further includes an intrusion detecting device at a first stage that is disposed at the outside of the electric wave transmitting unit and the electric wave receiving unit of the intrusion preventing area so as to be along the outer edge of the intrusion preventing area and initially detects intrusion of the intruder, the intrusion detecting device identifies an intruder as a detection target by determining whether a variation style for a predetermined time of intruder intrusion state information based on the reception signal of the electric wave receiving unit during a time period from the time when the intrusion detecting device at the first stage initially detects the intruder till the time when the intruder identifying sensor device does not detect the intruder is a predetermined variation style. Accordingly, an object which is not originally required to be detected is not recognized, and an intruding object (person) or the like which is originally required to be detected, that is, an intruder as a detection target can be identified.

Still furthermore, according to the present invention, an intruder identifying device includes: an electric wave transmitting unit and an electric wave receiving unit at least one of which is formed of a leakage coaxial cable laid on along the outer edge of an intrusion preventing area; an orthogonal detecting unit for extracting a complex reception signal obtained by delaying a reception signal by a propagation time from transmission of the reception signal to reception of the reception signal; a first complex signal accumulating unit for accumulating the complex reception signal every distance; a first calculating unit for outputting an intrusion state value of an intruder through a predetermined first complex calculation by using the complex reception signals which have been accumulated in the first complex signal accumulating unit for a predetermined past time from a present time to a predetermined past time; a first intrusion determining and outputting unit for outputting a first intrusion output when the intrusion state value calculated by the first calculating unit exceeds a preset predetermined threshold value; a second complex signal accumulating unit for accumulating the complex reception signal for a predetermined time after the first intrusion output is output; a second calculating unit for outputting a movement state of the intruder through a predetermined second complex calculation by using the complex reception signals accumulated by the second complex signal accumulating unit; and a second intrusion determining and outputting unit for determining intrusion of an intruder as a detection target on the basis of the movement state output from the second calculating unit and outputting the intrusion of the intruder as the detection target and the distance to the position of the intrusion of the intruder as the detection target. Accordingly, an object which is not originally required to be detected is not recognized, and an intruding object (person) or the like which is originally required to be detected, that is, an intruder as a detection target can be identified.

Still furthermore, according to the present invention, an intruder identifying sensor device for determining intrusion or non-intrusion of an intruder and an intrusion position on the basis of a reception signal of an electric wave receiving unit for receiving an electric wave emitted from an electric wave transmitting unit in the electric wave transmitting unit and the electric wave receiving unit at least one of which is formed of a leakage coaxial cable laid on along the outer edge of an intrusion preventing area, and outputting a reception signal, includes a predetermined-time intrusion continuation determining unit for identifying an intruder as a detection target by determining whether a variation style for a predetermined time of intruder intrusion state information based on the reception signal of the electric receiving unit during a time period from the time when the intruder is detected till the time when the intruder identifying sensor device does not detect the intruder is a predetermined style. Accordingly, an object which is not originally required to be detected is not recognized, and an intruding object (person) or the like which is originally required to be detected, that is, an intruder as a detection target can be identified.

The foregoing and other object, features, aspects and advantages of the present invention will become more apparent from the following detailed description of the present invention when taken in conjunction with the accompanying drawings.

BRIEF DESCRIPTION OF THE DRAWINGS

FIGS. 2A to 2F show the first embodiment of the present invention, and also show an example of the locus (vector locus) of the intrusion state of an intruder with time lapse with respect to the composite vector of a fundamental vector as the vector of a fundamental wave (a wave which is not interrupted by an intruder and thus is directly received from a transmission leakage coaxial cable by a reception leakage coaxial cable) in a reception signal of each intruder and a reflection wave vector as the vector of reflection wave reflected from the intruder and received by the reception leakage coaxial cable, wherein FIG. 2A shows a case example of the intrusion style when the intruder is a person, FIG. 2D shows an actual measurement case example of the vector locus when the intruder is a person, FIG. 2B shows a case example of the intrusion style when the intruder is a bird, FIG. 2E is an actual measurement case example of the vector locus when the intruder is a bird, FIG. 2C shows a case example of the intrusion style when the intruder is a pool of water occurring near to the leakage coaxial cable (which is an equivalent intruder because it does not physically intrude into the leakage coaxial cable, but the reflection wave from the pool of water affects the reception signal), and FIG. 2F is an actual measurement case example of the vector locus when the intruder is a pool of water;

DETAILED DESCRIPTION OF THE PREFERRED EMBODIMENTS

Preferred embodiments according to the present invention will be described hereunder.

First Embodiment

A first embodiment according to the present invention will be described with reference to FIGS. 1 to 5.

Figure 1:
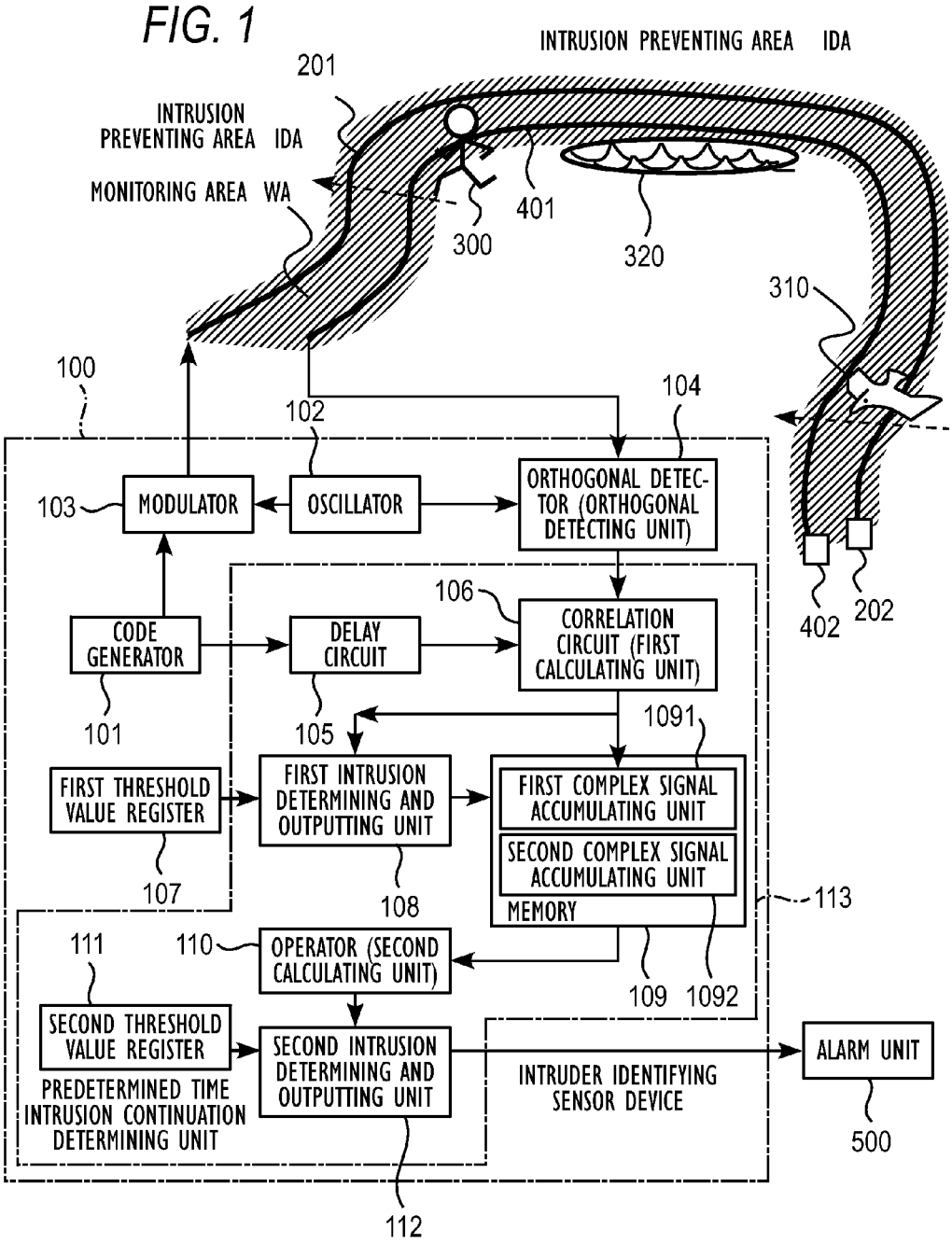
FIG. 1 is a diagram showing a first embodiment of the present invention, and also shows an example of the system construction of an intruder identifying device for executing an intruder identifying method and an example of the internal construction of an intruder identifying sensor device in the intruder identifying device.
Figure 2A:
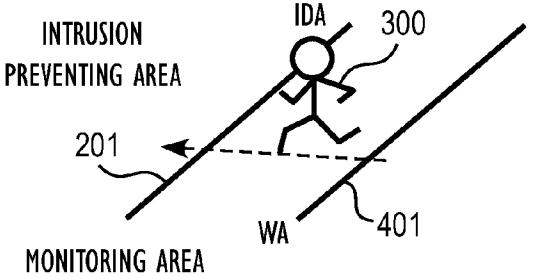
Figure 2B:
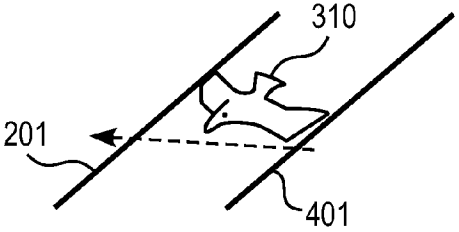
Figure 2C:
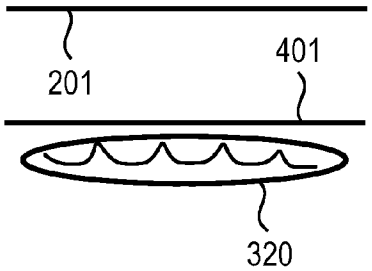
Figure 2D:
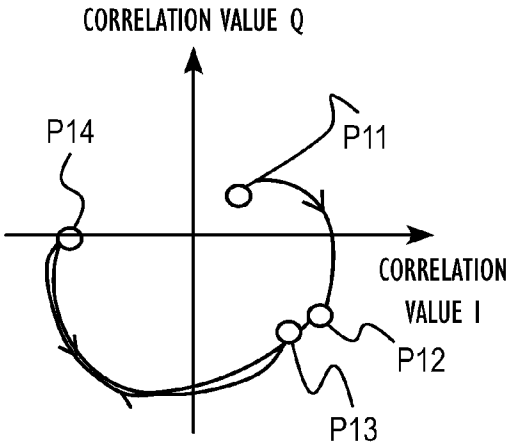
Figure 2E:
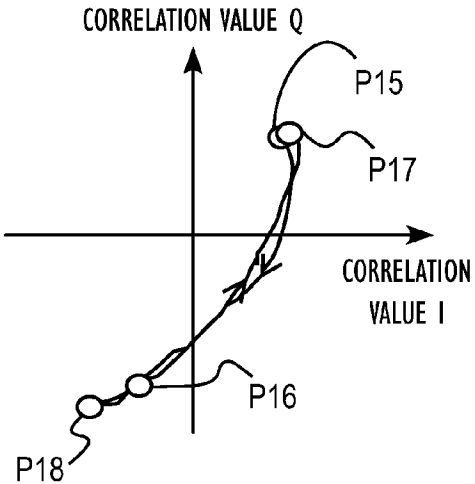
Figure 2F:
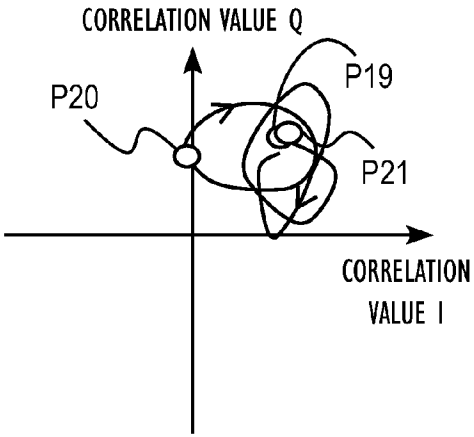
Figure 3:
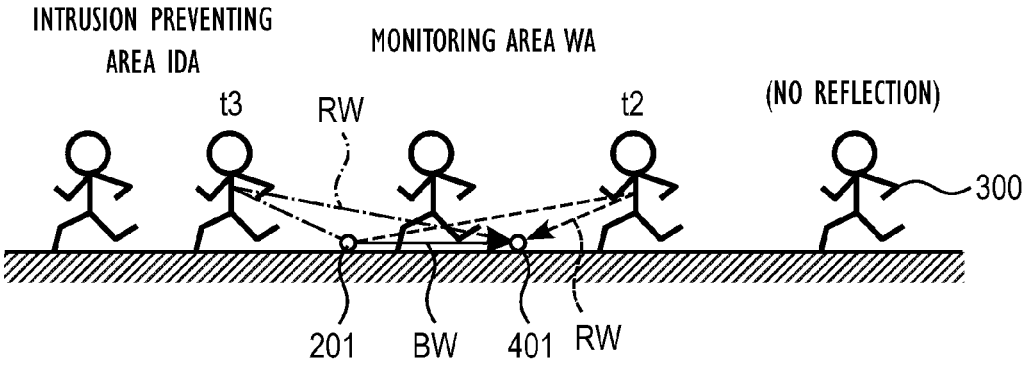
FIG. 3 shows the first embodiment of the present invention, and also is a diagram showing the relationship of an intrusion process of an intruder (person) or the like as a detection target, a fundamental wave (an electric wave which is not interrupted by the intruder, and is directly received from the transmission leakage coaxial cable by the reception leakage coaxial cable) and a reflection wave reflected from the intruder and received by the reception leakage coaxial cable.
Figure 4:
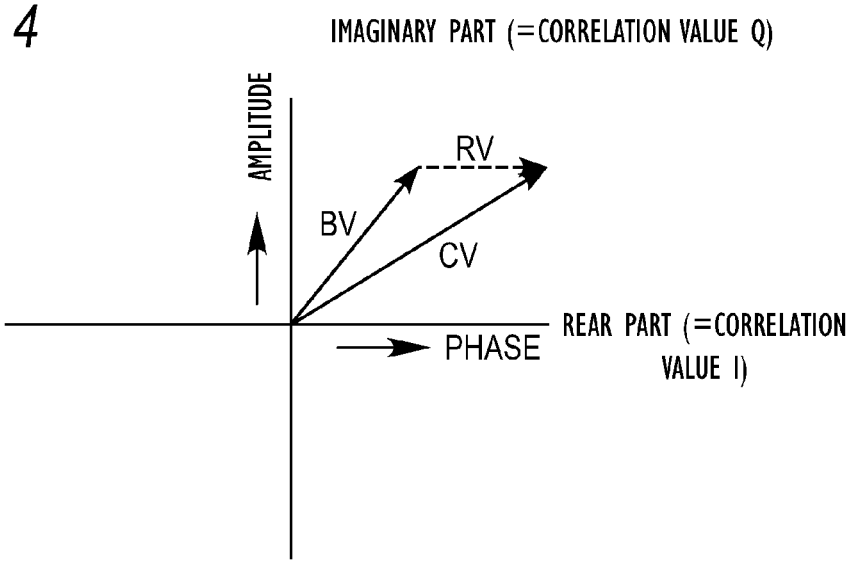
FIG. 4 shows the first embodiment of the present invention, and also is a diagram showing a fundamental vector, a reflection vector and a composite vector on the complex plane.
Figure 5:
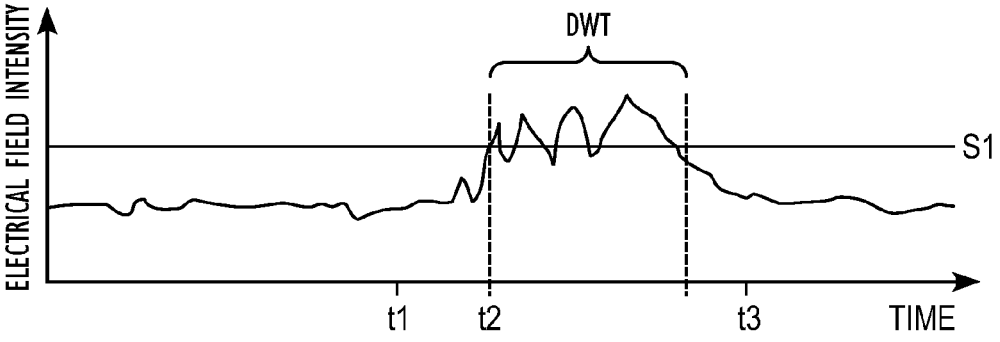
FIG. 5 shows the first embodiment of the present invention, and also is a diagram showing a variation state of the composite vector by using the electrical field intensity on the ordinate axis and the time (lapse time) on the abscissa axis.

FIG. 1 is a diagram showing an example of the system construction of an intruder identifying device for executing an intruder identifying method and an example of the internal construction of an intruder identifying sensor device in the intruder identifying device. FIGS. 2A to 2F show an example of the locus (vector locus) of the intrusion state of an intruder with time lapse with respect to the composite vector of a fundamental vector as the vector of a fundamental wave (a wave which is not interrupted by an intruder and thus is directly received from a transmission leakage coaxial cable by a reception leakage coaxial cable) in a reception signal of each intruder and a reflection wave vector as the vector of reflection wave reflected from the intruder and received by the reception leakage coaxial cable, wherein FIG. 2A shows a case example of the intrusion style when the intruder is a person, FIG. 2D shows an actual measurement case example of the vector locus when the intruder is a person, FIG. 2B shows a case example of the intrusion style when the intruder is a bird, FIG. 2E is an actual measurement case example of the vector locus when the intruder is a bird, FIG. 2C shows a case example of the intrusion style when the intruder is a pool of water occurring near to the leakage coaxial cable (which is an equivalent intruder because it does not physically intrude into the leakage coaxial cable, but the reflection wave from the pool of water affects the reception signal), and FIG. 2F is an actual measurement case example of the vector locus when the intruder is a pool of water. FIG. 3 is a diagram showing the relationship of an intrusion process of an intruder (person) or the like as a detection target, a fundamental wave (an electric wave which is not interrupted by the intruder, and is directly received from the transmission leakage coaxial cable by the reception leakage coaxial cable) and a reflection wave reflected from the intruder and received by the reception leakage coaxial cable, FIG. 4 is a diagram showing a fundamental vector, a reflection vector and a composite vector on the complex plane, and FIG. 5 is a diagram showing a variation state of the composite vector by using the electrical field intensity on the ordinate axis and the time (lapse time) on the abscissa axis.

The first embodiment of the present invention will be described hereunder with reference to FIG. 1.

The intruder identifying system of the first embodiment includes an intruder identifying sensor device 100, a transmission leakage coaxial cable (electric wave transmitting unit) 201, a reception leakage coaxial cable (electric wave receiving unit) 401 and an alarm unit 500 as shown in FIG. 1. Reference numeral 202 represents a terminating unit of the transmission leakage coaxial cable (electric wave transmitting unit) 201, and reference numeral 402 represents a terminating unit of the reception leakage coaxial cable (electric wave receiving unit) 401.

The intruder identifying sensor device 100 includes a code generator 101, an oscillator 102, a modulator 103, an orthogonal detector (orthogonal detecting unit) 104, a delay circuit 105, a correlation circuit which also serves as a first calculating unit (hereinafter referred to as "correlation circuit") 106, a first threshold value register 107, a first intrusion determining and outputting unit 108 including a determining unit (hereinafter referred to as "determining unit"), a memory 109, an operator as a second calculating unit (hereinafter referred to as "operator") 110, a second threshold value register 111 and a second intrusion determining and outputting unit including a determining unit (hereinafter referred to as "determining unit") 112.

The memory 109 has a first complex signal accumulating unit 1091 and a second complex signal accumulating unit 1092.

The delay circuit 105, the correlation circuit (first calculating unit) 106, the first intrusion determining and outputting unit 108, the memory 109, the operator (second calculating unit) 110, the second threshold value register 111 and the second intrusion determining and outputting unit 112 constitute a predetermined time intrusion continuation determining unit 113.

In FIG. 1, an electronic wave transmitting unit 201 formed of the transmission leakage coaxial cable and an electronic wave receiving unit 401 formed of the reception leakage coaxial cable are connected to the intruder identifying sensor device 100.

A transmission signal output from the intruder identifying sensor device 100 is emitted as a transmission electric wave from the electric wave transmitting unit 201 formed of the transmission leakage coaxial cable.

The transmission electric wave emitted from the electric wave transmitting unit 201 formed of the transmission leakage coaxial cable is reflected from an intruder (intruding object or intruding person) 300 as a detection target which is originally required to be detected and approaches to a monitoring area WA (the gap between the electric wave transmitting unit 201 and the electric wave receiving unit 401 formed of the leakage coaxial cables and the neighborhood of the gap) to intrude into an intrusion preventing (or prohibiting) area IDA, and the reflection wave concerned is received by the electric wave receiving unit 401 formed of the reception leakage coaxial cable and then input as a reception signal to the intruder identifying sensor device 100.

On the other hand, when there is an object which passes through the monitoring area WA at a high speed such as a bird 310 or the like which is not originally required to be detected, observed reflection intensity of the reflection wave from the object is strong if the object approaches to the electric wave transmission unit 201 or the electric wave receiving unit 401 formed of the leakage coaxial cable even when the object is such a small animal (object), and thus the reflection signal may be received by the electric wave receiving unit 401 formed of the transmission leakage coaxial cable.

Furthermore, the electric wave is also reflected by the wetness 320 of the ground surface of the monitoring area WA due to falling rain or the like, and this reflection signal may be received by the electric wave receiving unit 401 formed of the reception leakage coaxial cable.

The intruder identifying sensor device 100 detects the intruder 300 as a detection target to be originally detected by subjecting the various kinds of reflection signals described above to specific processing, and actuates the alarm unit 500.

The internal operation of the intruder identifying sensor device 100 executing this specific processing will be described hereunder.

The code generator 101 is a device for generating a pseudorandom code such as a well-known PN code or the like.

The modulator 103 modulates a carrier wave output from the oscillator 102 on the basis of a code signal generated by the code generator 101, and outputs the modulated carrier wave to the electric wave transmitting unit 201 formed of the leakage coaxial cable.

The reception signal received by the electric wave receiving unit 401 formed of the leakage coaxial cable is orthogonally detected on the basis of the carrier wave output from the oscillator 102 in the well-known orthogonal detector 104. The orthogonal detector 104 outputs an I signal and a Q signal by the orthogonal detection. In this case, the I signal and the Q signal are collectively called as a complex signal.

The complex signal is input to the correlation circuit 106. The code signal generated by the code generator 101 is delayed in the delay circuit 105 formed of a flip flop or the like, and the delayed code signal is input to the correlation circuit 106.

The correlation circuit 106 calculates the complex correlation value between the delay code signal and the complex signal, and outputs the calculated complex correlation value. The complex correlation value is the collective term of the correlation value I between the I signal and the delayed code signal and the correlation value Q between the Q signal and the delayed code signal.

The delay circuit 105 delays a delay target by the time corresponding to the propagation delay time for which the transmission electric wave emitted from the electric wave transmitting unit 201 formed of the leakage coaxial cable is directly received by the electric wave transmitting unit 401 formed of the leakage coaxial cable and the reception signal concerned is subjected to the orthogonal detection and then input to the correlation circuit 106.

Accordingly, only reflection from an object on the line connecting the electric wave transmitting unit 201 formed of the leakage coaxial cable and the electric wave receiving unit 201 formed of the leakage coaxial cable and in the neighborhood of the line has correlation. Electric wave reflection from a very remote place at the outside of the monitoring area WA has no correlation through the correlation calculation because the delay time is long. That is, an object at the outside of the monitoring area WA can be prevented from being misidentified.

The complex correlation value is input to the first intrusion determining and outputting unit 108. The first intrusion determining and outputting unit 108 compares a threshold value preset in the first threshold value register 107 with "root of (square of correlation value I+square of correlation value Q)". When the "root of (square of correlation value I+square of correlation value Q)" exceeds the first threshold value, a first intrusion output as an alarm signal (hereinafter referred to as "first alarm signal") is output to the memory 109.

The "root of (square of correlation value I+square of correlation value Q)" means "the composite vector CV on the complex plane obtained by combining a fundamental vector BV on the complex plane based on the reception signal which is received and output without being reflected from the intruder and a reflection wave vector RV on the complex plane based on the reception signal output from the electric wave receiving unit when the electric wave receiving unit receives the electric wave reflected from the intruder, as shown in FIG. 4. In the following description, the value of the composite vector CV on the complex plane is expressed as "complex correlation composite value".

FIG. 5 is a graph showing the variation of the detection pair of the "complex correlation composite value" of the composite vector CV in connection with intrusion of the intruder 300 into the monitoring area WA. In this graph, the ordinate axis represents the electrical field intensity, and the abscissa axis represents the lapse time. As shown in FIG. 5, with respect to DWT, the electrical field intensity increases conversely to the prior art from the time when the intruder 300 is detected by the intruder identifying sensor device 100 till the time when the intruder 300 is not detected by the intruder identifying sensor device 100.

When the memory 109 receives the first alarm signal, the memory 109 continues to accumulate the complex correlation value for a predetermined time, for example, for about 2 seconds. When the accumulation is completed, the accumulated complex correlation value over a predetermined time for 2 seconds before and after a time point when the first alarm signal occurs, as reference, is transmitted to the operator 110 from the accumulated complex correlation values.

The operator 110 analyzes the waveform pattern of the transmitted accumulated complex correlation value, and outputs the feature information of the waveform pattern to the determining unit 112.

Here, the waveform pattern (the time-variation pattern of the accumulated complex correlation value, that is, the pattern of the locus of the composite vector (the locus of the composite vector which varies with time lapse)) will be described with reference to FIG. 2.

FIG. 2D shows an example of the waveform pattern when the intruder is an intruder 300 as a so-called detection target such as an intruding object (person) or the like which is originally required to be detected and the waveform pattern is based on the intrusion of the intruder, FIG. 2E shows an example of the waveform pattern when the intruder is a bird 310 which is not originally required to be detected and the waveform pattern is based on the passing of the bird concerned, and FIG. 2F shows an example of the waveform pattern when the ground surface is wet and the water surface of a pool of water 320 is varied due to wind or the like.

In FIG. 2D, a point P 12 represents the complex correlation composite value at a time point t2 at which the first alarm signal occurs. Likewise, a point P11 represents the complex correlation composite value at a time point t1 which is prior to the time point t2 by a predetermined time, for example, 2 seconds. Likewise, a point P13 represents the complex correlation composite value at a time point which is subsequent to the time point t2 by a predetermined time, for example, 2 seconds and at which the accumulation has been completed.

As described above, when the intruder is the intruder 300 as a so-called detection target such as an intruding object (person) or the like which is originally required to be detected, the complex correlation composite value varies in a clockwise spiral shape from the point P11, passes over the point 12, returns at the point P14 and then reaches the point P13.

The phenomenon that the complex correlation composite value returns at the point P14 in connection with the movement of the intruder as the detection target occurs for the following reason. That is, as shown in the example of FIG. 3, when the intruder 300 as the detection target traverses the monitoring area WA from the outside of the intrusion preventing area IDA, passes through the monitoring area WA and intrudes into the intrusion preventing area IDA, the phase of reflection wave which is reflected from the intruder 300 as the detection target and received by the electric wave receiving unit 401 formed of the reception leakage coaxial cable is reversed before and after the intruder 300 passes through the monitoring area WA.

In FIG. 2E, a point P16 represents the complex correlation composite value at a time point when the first alarm signal occurs, a point P15 represents the complex correlation composite value at a time point which is prior to the above time point by 2 seconds, and a point P17 represents the complex correlation composite value at a time point which is subsequent to the above time point by 2 seconds and at which the accumulation is completed.

As described above, the complex correlation composite value rapidly varies from the point P15, passes over the point P16, returns at the point P18 and then reaches the point 17 due to the passing of the bird.

In FIG. 2F, a point P20 represents the complex correlation composite value at a time point when the first alarm signal occurs, a point P19 represents the complex correlation composites value at a time point which is prior to the above time point by 2 seconds, and a point P21 represents the complex correlation composite value at a time point which is subsequent to the above time point by 2 seconds and at which the accumulation is completed.

As described above, the complex correlation composite value randomly varies from the point P19 due to variation of the water surface of the pool of water 320.

As described above, the variation pattern of the complex correlation composite value (composite vector) varies in accordance with the type of the intruder passing through the monitoring area WA. The variation pattern varies dependently on the size, material, specific dielectric constant, electric conductivity, passing route, state variation, etc. of the intruder.

For example, a function fitting method based on a spiral function is used as a pattern analyzing method for identifying the waveform pattern corresponding to the intruder as the detection target from various kinds of waveform patterns corresponding to various types of intruders as described above. When the intruder 300 which is originally required to be detected intrudes into the monitoring area WA, the time-variation pattern of the complex correlation composite value based on the accumulated complex correlation value is characterized by the spiral rotation. Accordingly, for example, the helical radius of curvature of the time-variation pattern of the complex correlation composite value is output as a pattern matching index to the determining unit 112, whereby the intruder 300 as the detection target which is originally required to be detected can be identified by the determining unit 112.

A learning algorithm may be also used as the pattern matching index. This is operated to recognize the spiral rotation, and identification numbers (for example, intruder=1, bird=0) of the most proximate learning point in the k-NN method or the like may be used as an index.

The pattern returns at the point P14 in FIG. 2D, and this is a characteristic index which identifies the intruder 300 as the detection target which is originally required to be detected. In the case of the variation of the water surface in FIG. 2F, a pattern which is very near to the spiral rotation may occur in some cases. However, an erroneous report can be greatly suppressed by identifying an intruder in additional consideration of such a behavior that the circular orbit of the spiral continues for a while after the first alarm signal occurs and then returns. The identification containing the returning point can be more effectively performed by the learning algorithm method than the function fitting method.

This returning point is a characteristic phenomenon at the intrusion time which appears after normal detection (in this case, occurrence of the first alarm signal). Therefore, the intrusion determination can be surely performed by observing the returning point and using the returning point as a material for determining the intrusion of the intruder 300 as the detection target which is originally required to be detected.

The determining unit 112 determines the pattern matching index on the basis of the threshold value preset in the second threshold value register 111, and when there is a variation acceleration in the threshold value range, an alarm signal is output to the alarm unit 500.

When receiving the alarm signal, the alarm unit 500 announces an alert.

This embodiment is characterized in that the pattern analysis is performed by using the information after the time point when the first alarm signal occurs. For example, the point P12 of FIG. 2D corresponds to the time point at which the first alarm signal occurs. When the pattern analysis is performed at this time point, there is only information from the point P11 to the point P12, and thus this pattern is indistinguishable from the pattern of FIG. 2E.

That is, according to this embodiment, the variation pattern of the complex correlation composite value over a predetermined time in connection with the intrusion of an intruder is analyzed on the basis of the complex correlation composite values accumulated for a predetermined time additionally in consideration of the information after the time point when the first alarm signal occurs, whereby an erroneous report caused by a small flying object (small animal) such as a bird or the like and an erroneous report caused by environmental variation such as variation of the water surface or the like can be eliminated, and an intruder as a detection target which is originally required to be detected can be surely detected.

Second Embodiment

Figure 6:
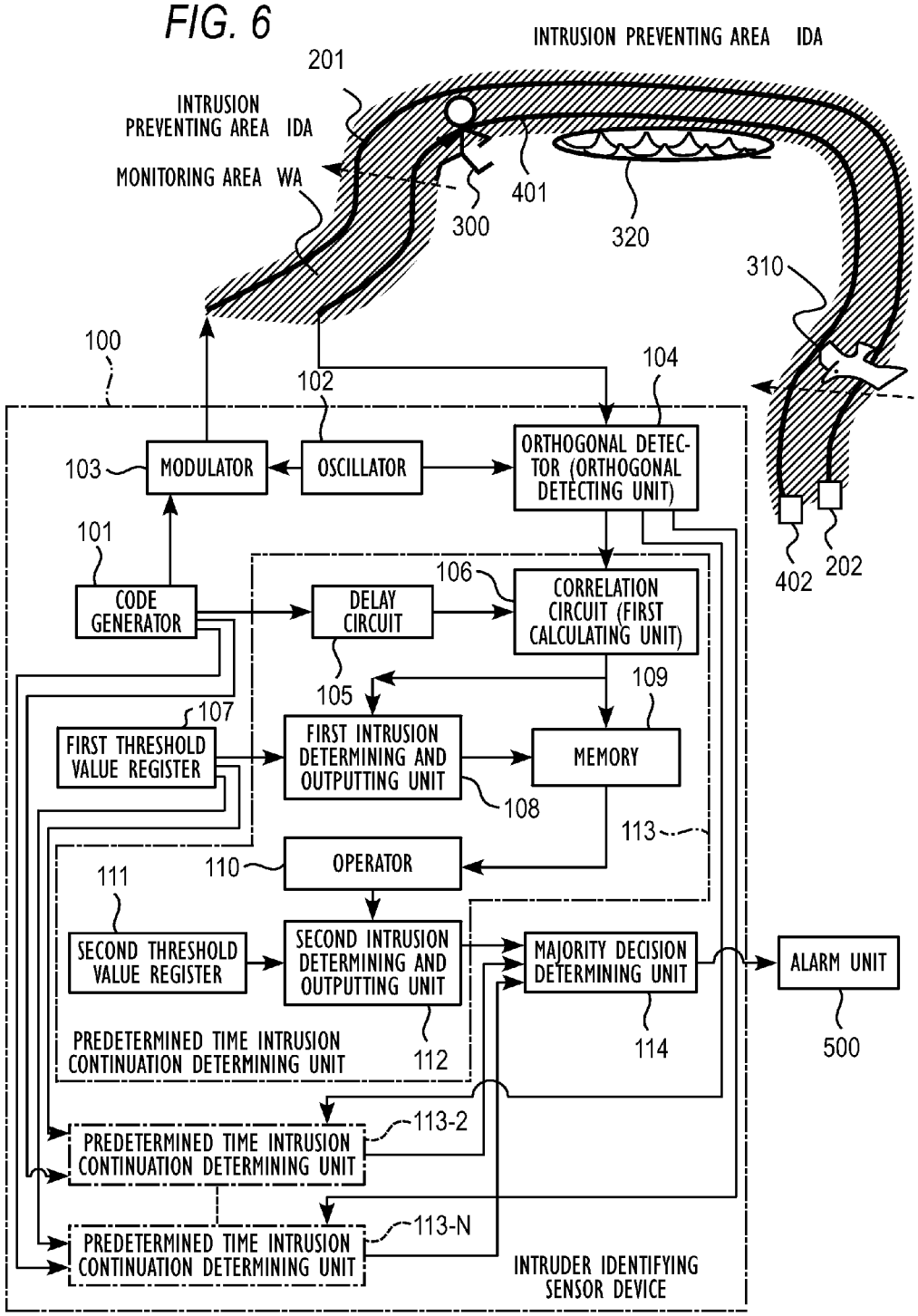
FIG. 6 shows a second embodiment of the present invention, and is a diagram showing an example of the system construction of an intruder identifying device for executing an intruder identifying method, and another example of the internal construction of the intruder identifying sensor device in the intruder identifying device.

A second embodiment according to the present invention will be described with reference to FIG. 6. FIG. 6 is a diagram showing an example of the system construction of the intruder identifying device for executing the intruder identifying method and another example of the internal construction of the intruder identifying sensor device in the intruder identifying device.

The detection is required to be carried out at all the places in the longitudinal direction of the leakage coaxial cable. Therefore, according to the second embodiment, in order to simultaneously observe plural points in the monitoring area WA, plural predetermined-time intrusion continuation determining units 113, 113-2 to **113-*n*** (surrounded with broken line) each of which comprises the delay circuit, the correlation circuit and the subsequent circuits are provided to observe the intrusion of intruders at plural places at the same time.

When the intrusion of an intruder is determined by a determining unit 112, the distance to the intruder concerned in the longitudinal direction of the leakage coaxial cable can be determined on the basis of the column number of the determining unit concerned. Therefore, the column number is converted to the distance, and the distance information is transmitted to the alarm unit 500, whereby the alarm unit 500 can output the information on the intrusion or non-intrusion and the intrusion position.

Here, it is assumed that an intruder moves in the longitudinal direction of the leakage coaxial cable. At this time, each of the determining units 112 of the plural predetermined-time intrusion continuation determining units 113, 113-2 to **113-*n* does not necessarily make the same determination. Accordingly, timely-sequential determination outputs of the respective determining units 112 are subjected to majority decision by a majority decision determining unit 114**, and a more accurate determination result is output.

For example, it is assumed that three predetermined-time intrusion continuation determining circuit 113 are mounted. In this case, when the determining unit 112 of the first predetermined-time intrusion continuation determining circuit 113, the determining unit 112 of the second predetermined-time intrusion continuation determining circuit 113-2 and the determining unit 112 of the third predetermined-time intrusion continuation determining circuit **113-*n* determine an intruder at three times like intrusion→intrusion→intrusion in connection with the movement of the intruder 300, and then there is a determination output of "bird (small animal) 310**", intrusion:small animal=3:1, and thus "intrusion" is determined.

As described above, when the electric wave transmitting unit 201 and the electric wave receiving unit 401 formed of the leakage coaxial cables are used, misidentification can be avoided by the majority decision although the determination result may be different halfway.

As described above, according to the second embodiment, intrusion or non-intrusion of an intruder as a detection target and the position of the intrusion can be surely output, and also the misidentification can be avoided by the majority decision, whereby the intrusion can be more surely detected.

Third Embodiment

Figure 7:
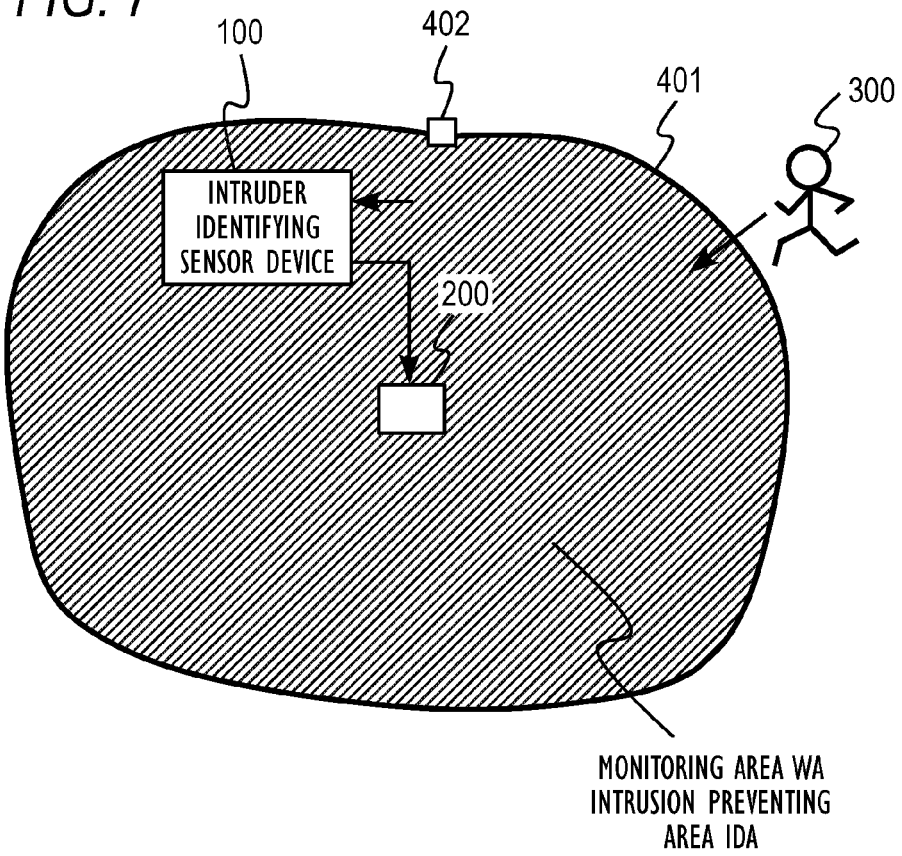
FIG. 7 shows a third embodiment of the present invention, and is a diagram conceptually showing another example of the system construction of the intruder identifying device.

A third embodiment will be described hereunder with reference to FIG. 7. FIG. 7 is a diagram conceptually showing another example of the system construction of the intruder identifying device.

According to the third embodiment, as shown conceptually in FIG. 7, a reception leakage coaxial cable 401 is used at the reception side, and a normal transmission antenna 200 which is not a leakage coaxial cable, but equivalent to a leakage coaxial cable and also can emit electric waves in a planar shape over 360° such as an array antenna or the like is used at the transmission side.

The reception leakage coaxial cable 401 is disposed in a circular shape, and a transmission antenna 200 is disposed at the center of the circle. With this arrangement, the monitoring area is set in a planar shape. By designing the system construction so that plural points can be observed simultaneously as described with reference to the second embodiment, any place of the circle from which an intruder intrudes can be specified.

Even when the transmission and reception antennas are replaced by each other, that is, the leakage coaxial cable is used as the transmission side while the normal antenna is used as the reception side, the same effect can be obtained.

As described above, according to the third embodiment, a planar area can be monitored by setting any one of the electric wave transmitting unit and the electric wave receiving unit to be a leakage coaxial cable.

Fourth Embodiment

Figure 8:
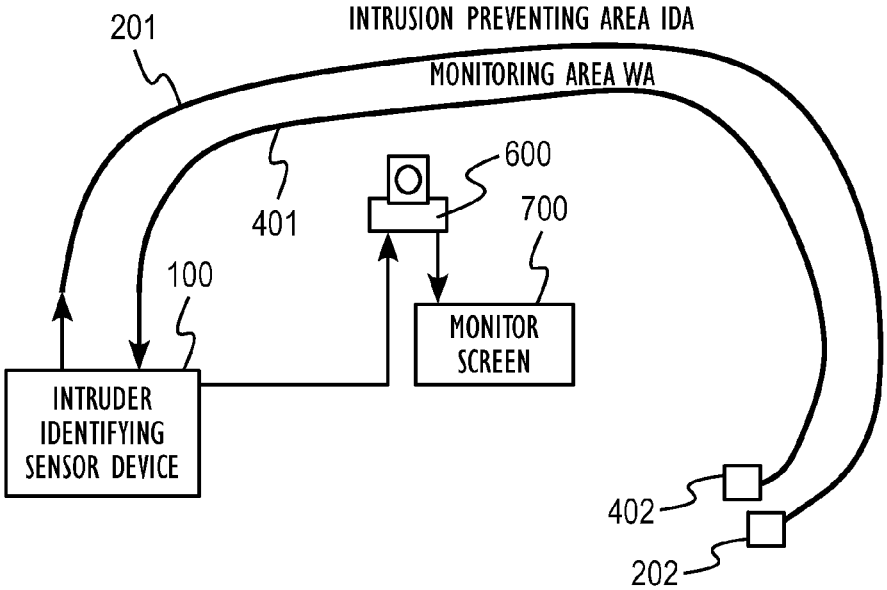
FIG. 8 shows a fourth embodiment of the present invention, and is a diagram conceptually showing another example of the system construction of the intruder identifying device.

A fourth embodiment will be described hereunder with reference to FIG. 8. FIG. 8 is a diagram conceptually showing still another example of the system construction of the intruder identifying device.

In this embodiment, the first alarm signal is output to the outside of the intruder identifying sensor device 100 and the rotational angle and zooming of a monitoring camera 600 are adjusted and controlled on the basis of the first alarm signal concerned as shown in FIG. 8.

As described with reference to the second embodiment, in the case where the system is constructed so that plural points can be observed at the same time, position information can be transmitted with the first alarm signal, and thus the monitor camera 600 can be oriented to an intruder in the monitoring area WA in a pinpoint style and a pickup image of the monitor camera 600 can be displayed on a monitor screen 700.

Thereafter, as described with reference to the first embodiment, the waveform pattern is analyzed and the alarm unit 500 announces an alarm when the intruder 300 as the detection target is detected.

It takes time to rotate the monitor camera 600, and thus when the alarm unit 500 is actuated and then the monitor camera 600 is rotated, a time delay occurs. Accordingly, when the intruder 300 as the detection target moves at a high speed, there is a risk that the intruder 300 as the detection target cannot be captured. Therefore, only the monitor camera 600 is made to get a shot at an intruder 300 as a detection target, and when the detection target is identified as an intruder by the intruder identifying sensor device 100, an alarm is announced. Through this operation, a watchdog may look at the monitor screen 700 only when the alarm unit 500 makes an alarm, and the monitoring quality can be enhanced.

As described above, the monitor camera 500 which requires time to respond is actuated before the intruder identifying sensor device 100 identifies an intruder as a detection target or the alarm unit 500 is actuated, and thus the intruder as the detection target can be surely checked at the time point when an alarm occurs.

Fifth Embodiment

Figure 9:
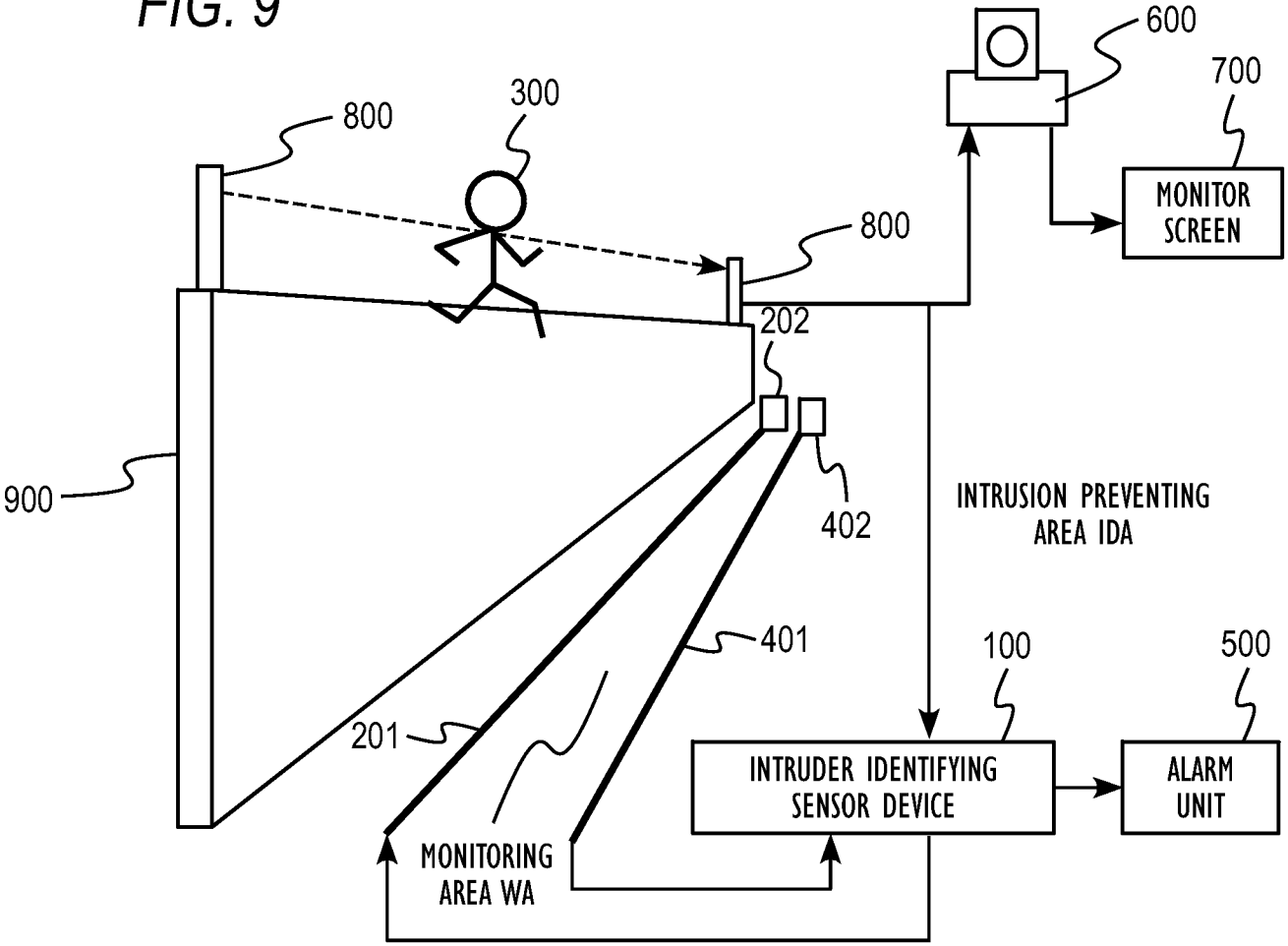
FIG. 9 shows a fifth embodiment of the present invention, and also is a diagram conceptually showing further another example of the system construction of the intruder identifying device.

A fifth embodiment will be described hereunder with reference to FIG. 9. FIG. 9 is a diagram conceptually showing still another example of the system construction of the intruder identifying device.

The fifth embodiment is characterized in that the first alarm signal is obtained from a sensor different from the intruder identifying sensor device 100.

In the fifth embodiment, as shown in FIG. 9, an intrusion detecting device 800 such as an optical sensor or the like at a first stage is disposed at the outside of the electric wave transmitting unit 201 and the electric wave receiving unit 401 of the intrusion preventing area IDA so as to be along the outer edge of the intrusion preventing area IDA. When detecting intrusion, the intrusion detecting device 800 at the first stage transmits a signal corresponding to the first alarm signal to the intruder identifying sensor device 100.

In the intruder identifying sensor device 100, the first alarm signal (first intrusion output signal) from the intrusion detecting device 800 at the first stage is connected to the memory 109 as in the case of the first to third embodiments, and then the intruder identifying sensor device 100 operates as described with reference to the first to third embodiments.

A well-known intrusion detecting device utilizing an optical sensor based on infrared ray, laser or the like or other devices may be used as the intrusion detecting device 800 at the first stage.

The intrusion detecting device 800 at the first stage is disposed at the upper portion of a fence or trench 900, for example.

When an intruder 300 intrudes, the intruder 300 is first captured by the intrusion detecting device 800 at the first stage. Thereafter, a reflection signal from the intruder 300 is captured by the intruder identifying sensor device 100 through the electric wave transmitting unit 201 and the electric wave receiving unit formed of the leakage coaxial cables. When it is determined through the waveform pattern recognition that the intruder is an intruder 300 as a detection target which is originally required to be detected as described with reference to the first to third embodiments, an alarm signal is transmitted from the intruder identifying sensor device 100 to the alarm unit 500 and an alarm is announced from the alarm unit 500.

Even when a small animal such as a bird, a cat or the like gets onto the trench 900 and thus the intrusion detecting device 800 at the first stage operates to transmit the first alarm signal (the first intrusion output signal) to the intruder identifying sensor device 100, it does not affect the electric waves of the electric wave transmitting unit 201 and the electric wave receiving unit formed of the leakage coaxial cables because the small animal such as the bird, the cat or the like stays on the trench 900, and thus the intruder identifying sensor device 100 does not detect any intruder, so that the alarm unit 500 does not announce any unnecessary alarm.

Furthermore, even when a small animal such as a bird or the like enters a region in which the electric waves of the electric transmitting unit 201 and the electric wave receiving unit 401 formed of the leakage coaxial cables are affected, the intrusion detecting device 800 at the first stage does not operate at that time, and the first alarm signal (first intrusion output signal) is not input to the intruder identifying sensor device 100, so that no unnecessary alarm is announced from the alarm unit 500. In this case, the intrusion of a bird or the like is prevented from being misidentified as the intrusion of the intruder 300 as the detection target by the pattern recognition in the intruder identifying sensor device 100.

Furthermore, in the first to third embodiments, when the electric wave transmitting unit 201 and the electric wave receiving unit 401 formed of the leakage coaxial cables are laid on at the side of a road on which a passenger exists, a reflection signal from the passenger is received by the electric wave receiving unit 401, and thus an unnecessary alarm may be announced. However, the first alarm signal (first intrusion output signal) is output by the intrusion detecting device 800 at the first stage such as an optical sensor or the like, so that no unnecessary alarm occurs. Furthermore, if only an optical sensor is used, leaves of a tree or a small animal would induce an alarm. However, the intrusion is identified on the basis of the combination of the optical sensor and the electric waves, and thus no unnecessary alarm is output.

The effect of the fourth embodiment can be added by rotating the monitor camera on the basis of the alarm signal generated by the intrusion detecting device 800 at the first stage as the other sensor.

As described above, according to the fifth embodiment, the first alarm (the first intrusion output signal) is output by the intrusion detecting device 800 at the first stage such as an optical sensor or the like which excludes electric waves, and the monitoring using electric waves is carried out at the second stage. Therefore, an erroneous report can be suppressed, and the intrusion detecting device of this embodiment can be disposed at a place such as a side of a road or the like at which an erroneous report may occur by only electric waves.

The embodiments described above may be the intruder identifying method, the intruder identifying device and the intruder identifying sensor device which are properly combined to actively utilize the respective advantages thereof.

In the figures, the same reference numerals represent the same or corresponding parts.

The first to fifth embodiments are configured as described above. The technical features of the present invention are as follows together with technical features from other viewpoints.

Characteristic Point 1

An intruder identifying method for detecting intrusion of an intruder by using an intruder identifying device having an electric wave transmitting unit formed of a leakage coaxial cable which is laid on along the outer edge of an intrusion preventing area and emits electric waves, an electric wave receiving unit formed of a leakage coaxial cable which is laid on along the outer edge of the intrusion preventing area and receives the electric waves emitted from the electric wave transmitting unit and outputs a reception signal, and an intruder identifying sensor device for determining intrusion or non-intrusion of an intruder into the intrusion preventing area and an intrusion position on the basis of the reception signal output from the electric wave receiving unit is characterized in that the intruder identifying sensor device identifies an intruder as a detection target by determining whether a variation style for a predetermined time of intruder intrusion state information based on the reception signal of the electric wave receiving unit during a time period from the time when the intruder identifying sensor device detects the intruder till the time when the intruder identifying sensor device does not detect the intruder is a predetermined variation style.

Characteristic Point 2

An intruder identifying method for detecting intrusion of an intruder by using an intruder identifying device having an electric wave transmitting unit formed of a leakage coaxial cable which is laid on along the outer edge of an intrusion preventing area and emits electric waves, an electric wave receiving unit which is laid on along the outer edge of the intrusion preventing area, formed of a leakage coaxial cable, receives the electric waves emitted from the electric wave transmitting unit, and outputs a reception signal, and an intruder identifying sensor device for determining intrusion or non-intrusion of an intruder into the intrusion preventing area and an intrusion position on the basis of the reception signal output from the electric wave receiving unit is characterized in that an intrusion detecting device at a first stage which is disposed at the outside of the electric wave transmitting unit and the electric wave receiving unit of the intrusion preventing area so as to be along the outer edge of the intrusion preventing area and initially detects intrusion of the intruder identifies an intruder as a detection target by determining whether a variation style for a predetermined time of intruder intrusion state information based on the reception signal of the electric wave receiving unit during a time period from the time when the intrusion detecting device at the first stage initially detects the intruder till the time when the intruder identifying sensor device does not detect the intruder is a predetermined variation style.

Characteristic Point 3

In the intruder identifying method described in the characteristic point 1 or the characteristic point 2, the intruder intrusion state information is information on a composite vector obtained by combining a fundamental vector based on the reception signal which is received and output without being reflected from the intruder and a reflection wave vector based on a reception signal which is output from the electric wave receiving unit by receiving electric waves reflected from the intruder, and an intruder as a detection target is identified by determining whether a vector locus style when the composite vector varies is a predetermined style.

Characteristic Point 4

In the intruder identifying method described in the characteristic point 3, the intruder as the detection target is identified by determining that the vector locus style when the composite vector varies is a predetermined returning pattern.

Characteristic Point 5

In the intruder identifying method described in the characteristic point 3, the intruder as the detection target is identified by determining that the vector locus style when the composite vector varies is a predetermined spiral pattern.

Characteristic Point 6

In the intruder identifying method described in the characteristic point 1 or the characteristic point 2, a monitor camera is controlled in a rotation monitoring mode on the basis of the detection of the intruder before the intruder as the detection target is identified.

Characteristic Point 7

An intruder identifying device having an electric wave transmitting unit formed of a leakage coaxial cable which is laid on along the outer edge of an intrusion preventing area and emits electric waves, an electric wave receiving unit formed of a leakage coaxial cable which is laid on along the outer edge of the intrusion preventing area and receives the electric waves emitted from the electric wave transmitting unit and outputs a reception signal, and an intruder identifying sensor device for determining intrusion or non-intrusion of an intruder and an intrusion position on the basis of the reception signal output from the electric wave receiving unit is characterized in that the intruder identifying sensor device identifies an intruder as a detection target by determining whether a variation style for a predetermined time of intruder intrusion state information based on the reception signal of the electric wave receiving unit during a time period from the time when the intruder identifying sensor device detects the intruder till the time when the intruder identifying sensor device does not detect the intruder is a predetermined variation style.

Characteristic Point 8

An intruder identifying device having an electric wave transmitting unit formed of a leakage coaxial cable which is laid on along the outer edge of an intrusion preventing area and emits electric waves, an electric wave receiving unit formed of a leakage coaxial cable which is laid on along the outer edge of the intrusion preventing area, receives the electric waves emitted from the electric wave transmitting unit, and outputs a reception signal, and an intruder identifying sensor device for determining intrusion or non-intrusion of an intruder into the intrusion preventing area and an intrusion position on the basis of the reception signal output from the electric wave receiving unit is characterized by further having an intrusion detecting device at a first stage that is disposed at the outside of the electric wave transmitting unit and the electric wave receiving unit of the intrusion preventing area so as to be along the outer edge of the intrusion preventing area and initially detects intrusion of the intruder, wherein the intrusion detecting device identifies an intruder as a detection target by determining whether a variation style for a predetermined time of intruder intrusion state information based on the reception signal of the electric wave receiving unit during a time period from the time when the intrusion detecting device at the first stage initially detects the intruder till the time when the intruder identifying sensor device does not detect the intruder is a predetermined variation style.

Characteristic Point 9

In the intruder identifying device described in the characteristic point 7 or the characteristic point 8, the intruder intrusion state information is information on a composite vector obtained by combining a fundamental vector based on the reception signal which is received and output without being reflected from the intruder and a reflection wave vector based on a reception signal which is output from the electric wave receiving unit by receiving electric waves reflected from the intruder, and an intruder as a detection target is identified by determining whether a vector locus style when the composite vector varies is a predetermined style.

Characteristic Point 10

In the intruder identifying device described in the characteristic point 9, the intruder as the detection target is identified by determining that the vector locus style when the composite vector varies is a predetermined returning pattern.

Characteristic Point 11

In the intruder identifying device described in the characteristic point 9, the intruder as the detection target is identified by determining that the vector locus style when the composite vector varies is a predetermined spiral pattern.

Characteristic Point 12

In the intruder identifying device described in the characteristic point 7 or the characteristic point 8, a monitor camera is controlled in a rotation monitoring mode on the basis of the detection of the intruder before the intruder as the detection target is identified.

Characteristic Point 13

An intruder identifying device includes: electric wave transmitting unit and an electric wave receiving unit at least one of which is a leakage coaxial cable laid on along the outer edge of an intrusion preventing area; an orthogonal detecting unit for extracting a complex reception signal obtained by delaying a reception signal by a propagation time from transmission of the reception signal to reception of the reception signal; a first complex signal accumulating unit for accumulating the complex reception signal every distance; a first calculating unit for outputting an intrusion state value of an intruder through a predetermined first complex calculation by using complex reception signals which have been accumulated in the first complex signal accumulating unit for a predetermined past time from a present time to a predetermined past time; a first intrusion determining and outputting unit for outputting a first intrusion output when the intrusion state value calculated by the first calculating unit exceeds a preset predetermined threshold value; a second complex signal accumulating unit for accumulating the complex reception signal for a predetermined time after the first intrusion output is output; a second calculating unit for outputting a movement state of the intruder through a predetermined second complex calculation by using complex reception signals accumulated by the second complex signal accumulating unit; and a second intrusion determining and outputting unit for determining intrusion of an intruder as a detection target on the basis of the movement state output from the second calculating unit and outputting the intrusion of the intruder as the detection target and the distance to the position of the intrusion of the intruder as the detection target.

Characteristic Point 14

In the intruder identifying device described in the characteristic point 13, the intruder as a detection target is identified by determining whether a vector locus style when a composite vector on a complex plane which is obtained by combining a fundamental vector on a complex plane based on the reception signal which is received and output without being reflected from the intruder by the output of the movement state of the intruder and a reflection wave vector on a complex plane based on a reception signal which is output from the electric wave receiving unit by receiving electric waves reflected from the intruder, varies is a predetermined style.

Characteristic Point 15

In the intruder identifying device described in the characteristic point 14, the intruder as the detection target is identified by determining that the vector locus style when the composite vector varies is a predetermined returning pattern.

Characteristic Point 16

In the intruder identifying device described in the characteristic point 14, the intruder as the detection target is identified by determining that the vector locus style when the composite vector varies is a predetermined spiral pattern.

Characteristic Point 17

In the intruder identifying device described in the characteristic point 13, a plurality of predetermined-time intrusion continuation determining units each of which comprises the first and second complex signal accumulating units, the first and second calculating units and the first and second intrusion determining and outputting units are provided, and each of the plural predetermined-time intrusion continuation determining units determines intrusion of an intruder as a detection target.

Characteristic Point 18

In the intruder identifying device described in the characteristic point 17, intrusion of an intruder as a detection target is determined on the basis of majority decision from the outputs of the movement states from the respective second calculating units of the plural predetermined-time intrusion continuation determining units by a majority decision determining unit.

Characteristic Point 19

In the intruder identifying device described in the characteristic point 13, a monitor camera is controlled in a rotational monitoring mode on the basis of the output of the first calculating unit before the intrusion of the intruder as the detection target is determined by the second intrusion determining unit.

Characteristic Point 20

An intruder identifying sensor device for determining intrusion or non-intrusion of an intruder and an intrusion position on the basis of a reception signal of an electric wave receiving unit for receiving an electric wave emitted from an electric wave transmitting unit in the electric wave transmitting unit and the electric wave receiving unit at least one of which is formed of a leakage coaxial cable laid on along the outer edge of an intrusion preventing area, and outputting a reception signal is characterized by further comprising a predetermined-time intrusion continuation determining unit for identifying an intruder as a detection target by determining whether a variation style for a predetermined time of intruder intrusion state information based on the reception signal of the electric receiving unit during a time period from the time when the intruder is detected till the time when the intruder identifying sensor device does not detect the intruder is a predetermined style.

Characteristic Point 21

In the intruder identifying sensor device described in the characteristic point 20, the intruder intrusion state information is information on a composite vector obtained by combining a fundamental vector based on the reception signal which is received and output without being reflected from the intruder and a reflection wave vector based on a reception signal which is output from the electric wave receiving unit by receiving electric waves reflected from the intruder, and an intruder as a detection target is identified by determining whether a vector locus style when the composite vector varies is a predetermined style.

Characteristic Point 22

In the intruder identifying sensor device described in the characteristic point 21, the intruder as the detection target is identified by determining that the vector locus style when the composite vector varies is a predetermined returning pattern.

Characteristic Point 23

In the intruder identifying sensor device described in the characteristic point 21, the intruder as the detection target is identified by determining that the vector locus style when the composite vector varies is a predetermined spiral pattern.

Characteristic Point 24

An intruder identifying device comprises: an electric wave transmitting unit for transmitting a detection electric wave; an electric wave receiving unit for receiving the detection electric wave and outputting a reception signal; an orthogonal detection correlation unit for extracting a complex reception signal obtained by delaying the reception signal by only a propagation time from transmission till reception; a complex signal accumulating unit (first complex signal accumulating unit) that accumulates the complex reception signal and is numbered with each distance; a first calculating unit for outputting a first state numerical value through a predetermined complex operation by using complex reception signals accumulated from a present time point to a predetermined past time; a first alarm unit for determining the first state numerical value with a preset predetermined threshold value and outputting a first alarm when the first state numerical value exceeds the predetermined threshold value; an additional complex signal accumulating unit (second complex signal accumulating unit) for further accumulating the complex reception signal by only a predetermined time after the first alarm is output; a second calculating unit for combining the complex reception signals accumulated by the additional complex signal accumulating unit (second complex accumulating unit) with the complex reception signals accumulated by the complex signal accumulating unit (first complex signal accumulating unit) and outputting a second state numerical value through a predetermined second complex calculation; and a last alarm unit (second alarm unit) for determining the second state numeral value with a predetermined second threshold value and outputting a last alarm (second alarm) and the distance when the second state numerical value exceeds the preset predetermined second threshold value.

Characteristic Point 25

In the intruder identifying device described in the characteristic point 24, both or one of the electric wave transmitting unit and the electric wave receiving unit comprises a leakage coaxial cable.

Characteristic Point 26

The intruder identifying device described in the characteristic point 24 or the characteristic point 25 is further equipped with a second calculating unit for extracting a return pattern of a waveform pattern from the complex reception signal accumulated in the additional complex signal accumulating unit (second complex signal accumulating unit), and outputting the degree of the return pattern concerned.

Characteristic Point 27

In the intruder identifying device described in the characteristic point 24 or the characteristic point 25, the second calculating unit outputs a fitting state of a spiral waveform as the second state numerical value to the pattern extraction.

Characteristic Point 28

The intruder identifying device described in the characteristic point 25 is provided with a plurality of orthogonal detection correlation units, a plurality of complex signal accumulating units (first complex signal accumulating units), a plurality of first calculating units, a plurality of first alarm units, a plurality of additional complex signal accumulating units (second complex signal accumulating units) and a plurality of second calculating units that are respectively operated in parallel.

Characteristic Point 29

The intruder identifying device described in the characteristic point 28 is equipped with a majority decision determining unit for subjecting the outputs of the plurality of second calculating units to majority decision.

Characteristic Point 30

In the intruder identifying device described in the characteristic point 24 or the characteristic point 25, the output of the first alarm unit is transmitted to a camera control unit, and a camera is controlled to capture an intruder by the camera control unit before the last alarm unit (second alarm unit) outputs an alarm.

Characteristic Point 31

An intruder identifying device comprises: an electric wave transmitting unit for transmitting a detection electric wave; an electric wave receiving unit for receiving the detection electric wave and outputting a reception signal; an orthogonal detection correlation unit for extracting a complex reception signal obtained by delaying the reception signal by only a propagation time from transmission till reception; a complex signal accumulating unit that accumulates the complex reception signal and is numbered with each distance; an additional complex signal accumulating unit for further accumulating the complex reception signal for only a predetermined time upon receiving a first alarm from an external device; a second calculating unit for combining the complex reception signal accumulated by the additional complex signal accumulating unit with the complex reception signal accumulated by the complex signal accumulating unit and outputting a second state numerical value through a predetermined second complex calculation; and a last alarm unit for determining the second state numerical value with a preset predetermined second threshold value and outputting a last alarm and a distance when the second state numerical value exceeds the second threshold value.

Characteristic Point 32

In the intruder identifying device described in the characteristic point 31, both or one of the electric wave transmitting unit and the electric wave receiving unit comprises a leakage coaxial cable.

Characteristic Point 33

The intruder identifying device described in the characteristic point 31 or the characteristic point 32 is equipped with a second calculating unit for extracting a return pattern of a waveform pattern from the complex reception signal accumulated by the additional complex signal accumulating unit and outputting the degree of the return pattern.

Characteristic Point 34

In the intruder identifying device as described in the characteristic point 31 or the characteristic point 32, the second calculating unit outputs a fitting state of a spiral waveform as the second state numerical value to the pattern extraction.

Characteristic Point 35

The intruder identifying device described in the characteristic point 32 is equipped with a plurality of orthogonal detection correlation units, a plurality of complex signal accumulating units, a plurality of calculating units, a plurality of first alarm units, a plurality of additional complex signal accumulating units and a plurality of second calculating units that operate in parallel.

Characteristic Point 36

The intruder identifying device described in the characteristic point 35 is equipped with a majority decision determining unit for subjecting the outputs of the plural second calculating units to majority decision.

Characteristic Point 37

In the intruder identifying device described in characteristic point 31 or the characteristic point 32, a first alarm is transmitted from an external device to a camera control unit, and a camera is controlled to capture an intruder by the camera control unit before a last alarm unit outputs an alarm.

Various modifications and alterations of this invention will be apparent to those skilled in the art without departing from the scope and spirit of this invention, and it should be understood that this is not limited to the illustrative embodiments set forth herein.

FIGS. 1, 6

100 . . . INTRUDER IDENTIFYING SENSOR DEVICE
101 . . . CODE GENERATOR
102 . . . OSCILLATOR
103 . . . MODULATOR
104 . . . ORTHOGONAL DETECTOR (ORTHOGONAL DETECTING UNIT)
105 . . . DELAY CIRCUIT
106 . . . CORRELATION CIRCUIT (FIRST CALCULATING UNIT)
107 . . . FIRST THRESHOLD VALUE REGISTER
108 . . . FIRST INTRUSION DETERMINING AND OUTPUTTING UNIT
109 . . . MEMORY
1091 . . . FIRST COMPLEX SIGNAL ACCUMULATING UNIT
1092 . . . SECOND COMPLEX SIGNAL ACCUMULATING UNIT

110 . . . OPERATOR (SECOND CALCULATING UNIT)
111 . . . SECOND THRESHOLD VALUE REGISTER
112 . . . SECOND INTRUSION DETERMINING AND OUTPUTTING UNIT
113 . . . PREDETERMINED TIME INTRUSION CONTINUATION DETERMINING UNIT
113-2 . . . **113-*n*** . . . PREDETERMINED TIME INTRUSION CONTINUATION DETERMINING UNIT
114 . . . MAJORITY DECISION DETERMINING UNIT
500 . . . ALARM UNIT
IDA . . . INTRUSION PREVENTING AREA
WA . . . MONITORING AREA
FIG. 2A TO 2C
INTRUSION PREVENTING AREA IDA
MONITORING AREA WA
CORRELATION VALUE Q, CORRELATION VALUE I
FIG. 3
INTRUSION PREVENTING AREA IDA, MONITORING AREA WA, (NO REFLECTION)
FIG. 4
AMPLITUDE, PHASE
IMAGINARY PART (=CORRELATION VALUE Q), REAR PART (=CORRELATION VALUE I)
FIG. 5
Electrical Field Intensity
TIME
FIG. 7
Monitoring AREA WA
INTRUSION PREVENTING AREA IDA
100 . . . INTRUDER IDENTIFYING SENSOR DEVICE
FIG. 8
100 . . . INTRUDER IDENTIFYING SENSOR DEVICE
700 . . . MONITOR SCREEN
INTRUSION PREVENTING AREA IDA
MONITORING AREA WA
FIG. 9
100 . . . INTRUDER IDENTIFYING SENSOR DEVICE
500 . . . ALARM UNIT
700 . . . MONITOR SCREEN
INTRUSION PREVENTING AREA IDA
MONITORING AREA WA

What is claimed is:

1. An intruder identifying method for detecting intrusion of an intruder by using an intruder identifying device comprising an electric wave transmitting unit including a leakage coaxial cable which is laid along the outer edge of an intrusion preventing area and emits electric waves, an electric wave receiving unit including a leakage coaxial cable which is laid along the outer edge of the intrusion preventing area, which receives the electric waves emitted from the electric wave transmitting unit and outputs a reception signal, and an intruder identifying sensor device for determining intrusion or non-intrusion of an intruder into the intrusion preventing area and an intrusion position on the basis of the reception signal output from the electric wave receiving unit, wherein the intruder identifying sensor device identifies an intruder, as a detection target, by determining: whether a variation style, for a predetermined time, of intruder intrusion state information based on the reception signal of the electric wave receiving unit during a time period, from the time when the intruder identifying sensor device detects the intruder, until the time when the intruder identifying sensor device does not detect the intruder, is a predetermined variation style that corresponds to a predetermined shape, and wherein the intruder intrusion state information is information on a composite vector, and the variation style is a vector locus style of the composite vector when the composite vector varies.

2. An intruder identifying method for detecting intrusion of an intruder by using an intruder identifying device comprising an electric wave transmitting unit including a leakage coaxial cable which is laid along the outer edge of an intrusion preventing area and emits electric waves, an electric wave receiving unit which is laid along the outer edge of the intrusion preventing area and comprises a leakage coaxial cable, which receives the electric waves emitted from the electric wave transmitting unit and outputs a reception signal, a first stage intrusion detecting device disposed at the outside of the electric wave transmitting unit and the electric wave receiving unit of the intrusion preventing area so as to be along the outer edge of the intrusion preventing area, and an intruder identifying sensor device for determining intrusion or non-intrusion of an intruder into the intrusion preventing area and an intrusion position on the basis of the reception signal output from the electric wave receiving unit, wherein the intruder identifying sensor device identifies an intruder, as a detection target, by determining:

whether a variation style of intruder intrusion state information based on the reception signal of the electric wave receiving unit during a time period, from the time when the first stage intrusion detecting device initially detects the intruder, until the time when the intruder identifying sensor device does not detect the intruder, is a predetermined variation style that corresponds to a predetermined shape, and wherein the intruder intrusion state information is information on a composite vector, and the variation style is a vector locus style of the composite vector when the composite vector varies.

3. The intruder identifying method according to claim 1, wherein the composite vector is obtained by combining a fundamental vector based on the reception signal which is received and output without being reflected from the intruder and a reflection wave vector based on a reception signal which is output from the electric wave receiving unit by receiving electric waves reflected from the intruder.

4. The intruder identifying method according to claim 2, wherein the composite vector is obtained by combining a fundamental vector based on the reception signal which is received and output without being reflected from the intruder and a reflection wave vector based on a reception signal which is output from the electric wave receiving unit by receiving electric waves reflected from the intruder.

5. The intruder identifying method according to claim 3, wherein the predetermined shape is a predetermined returning pattern.

6. The intruder identifying method according to claim 4, wherein the predetermined shape is a predetermined returning pattern.

7. The intruder identifying method according to claim 3, wherein the predetermined shape is a predetermined spiral pattern.

8. The intruder identifying method according to claim 4, wherein the predetermined shape is a predetermined spiral pattern.

9. The intruder identifying method according to claim 1, wherein a monitor camera is controlled to rotate to monitor the intruder based on when the intruder identifying sensor device detects the intruder, but before the intruder is identified as the detection target.

10. The intruder identifying method according to claim 2, wherein a monitor camera is controlled to rotate to monitor the intruder based on when the first stage intrusion detecting device initially detects the intruder.

11. An intruder identifying device comprising;

an electric wave transmitting unit formed of a leakage coaxial cable which is laid along the outer edge of an intrusion preventing area and emits electric waves, an electric wave receiving unit comprising a leakage coaxial cable which is laid along the outer edge of the intrusion preventing area and receives the electric waves emitted from the electric wave transmitting unit and outputs a reception signal, and an intruder identifying sensor device for determining intrusion or non-intrusion of an intruder and an intrusion position on the basis of the reception signal output from the electric wave receiving unit, wherein the intruder identifying sensor device is configured to identify an intruder, as a detection target, by determining:

whether a variation style of intruder intrusion state information, for a predetermined time, based on the reception signal of the electric wave receiving unit during a time period from the time when the intruder identifying sensor device detects the intruder until the time when the intruder identifying sensor device does not detect the intruder is a predetermined variation style that corresponds to a predetermined shape, and wherein the intruder intrusion state information is information on a composite vector, and the variation style is a vector locus style of the composite vector when the composite vector varies.

12. An intruder identifying device comprising:

an electric wave transmitting unit formed of a leakage coaxial cable which is laid along the outer edge of an intrusion preventing area and emits electric waves, an electric wave receiving unit which is laid along the outer edge of the intrusion preventing area and comprises a leakage coaxial cable and receives the electric waves emitted from the electric wave transmitting unit and outputs a reception signal, an intruder identifying sensor device for determining intrusion or non-intrusion of an intruder into the intrusion preventing area and an intrusion position on the basis of the reception signal output from the electric wave receiving unit, and a first stage intrusion detecting device that is disposed at the outside of the electric wave transmitting unit and the electric wave receiving unit of the intrusion preventing area so as to be along the outer edge of the intrusion preventing area, wherein the intruder identifying sensor device is configured to identify an intruder, as a detection target, by determining:

whether a variation style of intruder intrusion state information based on the reception signal of the electric wave receiving unit during a time period, from the time when the first stage intrusion detecting device initially detects the intruder, until the time when the intruder identifying sensor device does not detect the intruder, is a predetermined variation style that corresponds to a predetermined shape, and wherein the intruder intrusion state information is information on a composite vector, and the variation style is a vector locus style of the composite vector when the composite vector varies.

13. The intruder identifying device according to claim 11, wherein the composite vector is obtained by combining a fundamental vector based on the reception signal which is received and output without being reflected from the intruder and a reflection wave vector based on a reception signal which is output from the electric wave receiving unit by receiving electric waves reflected from the intruder.

14. The intruder identifying device according to claim 12, wherein the composite vector is obtained by combining a fundamental vector based on the reception signal which is received and output without being reflected from the intruder and a reflection wave vector based on a reception signal which is output from the electric wave receiving unit by receiving electric waves reflected from the intruder.

15. The intruder identifying device according to claim 13, wherein the predetermined shape is a predetermined returning pattern.

16. The intruder identifying device according to claim 14, wherein the predetermined shape is a predetermined returning pattern.

17. The intruder identifying device according to claim 13, wherein the predetermined shape is a predetermined spiral pattern.

18. The intruder identifying device according to claim 14, wherein the predetermined shape is a predetermined spiral pattern.

19. The intruder identifying device according to claim 11, wherein a monitor camera is controlled to rotate to monitor the intruder based on when the intruder identifying sensor device initially detects the intruder, but before the intruder is identified as the detection target.

20. The intruder identifying device according to claim 12, wherein a monitor camera is controlled to rotate to monitor the intruder based on when the first stage intrusion detecting device initially detects the intruder.

21. An intruder identifying device comprising:

an electric wave transmitting unit and an electric wave receiving unit at least one of which is laid along the outer edge of an intrusion preventing area;

an orthogonal detecting unit for extracting a complex reception signal obtained by delaying a reception signal by a propagation time from transmission of the reception signal to reception of the reception signal;

a first complex signal accumulating unit for accumulating the complex reception signal over time;

a first calculating unit for outputting an intrusion state value of an intruder through a predetermined first complex calculation by using complex reception signals which have been accumulated in the first complex signal accumulating unit for a predetermined past time from a present time to a predetermined past time;

a first intrusion determining and outputting unit for outputting a first intrusion output when the intrusion state value calculated by the first calculating unit exceeds a preset predetermined threshold value;

a second complex signal accumulating unit for accumulating the complex reception signal for a predetermined time after the first intrusion output is output;

a second calculating unit for outputting a movement state of the intruder through a predetermined second complex calculation by using complex reception signals accumulated by the second complex signal accumulating unit; and a second intrusion determining and outputting unit for determining intrusion of the intruder as a detection target on the basis of the movement state output from the second calculating unit and outputting the intrusion of the intruder as the detection target and the distance to the position of the intrusion of the intruder as the detection target.

22. The intruder identifying device according to claim 21, wherein the intruder as the detection target is identified by determining whether a vector locus pattern, when a composite vector on a complex plane which is obtained by combining a fundamental vector on a complex plane based on the reception signal which is received and output without being reflected from the intruder by the output of the movement state of the intruder and a reflection wave vector on a complex plane based on a reception signal which is output from the electric wave receiving unit by receiving electric waves reflected from the intruder, varies in a predetermined pattern.

23. The intruder identifying device according to claim 22, wherein the intruder as the detection target is identified by determining that the vector locus pattern when the composite vector varies is a predetermined returning pattern.

24. The intruder identifying device according to claim 22, wherein the intruder as the detection target is identified by determining that the vector locus pattern when the composite vector varies is a predetermined spiral pattern.

25. The intruder identifying device according to claim 21, wherein a plurality of predetermined-time intrusion continuation determining units, each of which comprises the first and second complex signal accumulating units, the first and second calculating units and the first and second intrusion determining and outputting units, are provided, and each of the plural predetermined-time intrusion continuation determining units determines intrusion of an intruder as a detection target.

26. The intruder identifying device according to claim 25, wherein intrusion of the intruder as the detection target is determined on the basis of majority decision from the outputs of the movement states from the respective second calculating units of the plural predetermined-time intrusion continuation determining units by a majority decision determining unit.

27. The intruder identifying device according to claim 21, wherein a monitor camera is controlled in a rotational monitoring mode on the basis of the output of the first calculating unit before the intrusion of the intruder, as the detection target, is determined by the second intrusion determining unit.

28. An intruder identifying sensor device for determining intrusion or non-intrusion of an intruder and an intrusion position, on the basis of a reception signal of an electric wave receiving unit configured to receive an electric wave emitted from an electric wave transmitting unit and to output the reception signal, wherein at least one of the electric wave transmitting unit and the electric wave receiving unit includes a leakage coaxial cable laid along the outer edge of an intrusion preventing area, wherein the intruder identifying sensor device further comprises a predetermined-time intrusion continuation determining unit configured to identify the intruder, as a detection target, by determining:

whether a variation style, for a predetermined time, of intruder intrusion state information based on the reception signal of the electric receiving unit during a time period from the time when the intruder is detected till the time when the intruder identifying sensor device does not detect the intruder is a predetermined style that corresponds to a predetermined shape, wherein the intruder intrusion state information is information on a composite vector, and the variation style is a vector locus style of the composite vector when the composite vector varies.

29. The intruder identifying sensor device according to claim 28, wherein the composite vector is obtained by combining a fundamental vector based on the reception signal which is received and output without being reflected from the intruder and a reflection wave vector based on a reception signal which is output from the electric wave receiving unit by receiving electric waves reflected from the intruder.

30. The intruder identifying sensor device according to claim 29, wherein the predetermined shape is a predetermined returning pattern.

31. The intruder identifying sensor device according to claim 30, wherein the predetermined shape is a predetermined spiral pattern.

* * * * *